US006196951B1

(12) United States Patent
Shepherd

(10) Patent No.: US 6,196,951 B1
(45) Date of Patent: Mar. 6, 2001

(54) WEIGHTLIFTING APPARATUS FOR EXERCISING THE TRICEPS

(76) Inventor: Rodney Shepherd, 16737 Capon Tree La., Woodbridge, VA (US) 22191

( * ) Notice: Subject to any disclaimer, the term of this patent is extended or adjusted under 35 U.S.C. 154(b) by 0 days.

(21) Appl. No.: 09/389,495

(22) Filed: Sep. 3, 1999

(51) Int. Cl.[7] ..... A63B 21/072
(52) U.S. Cl. ..... 482/106; 482/93
(58) Field of Search ..... 482/44, 98, 104–109, 482/139, 140, 93; D21/662, 679, 680, 681, 683

(56) References Cited

U.S. PATENT DOCUMENTS

| | | | | |
|---|---|---|---|---|
| D. 276,835 | * | 12/1984 | Killen | D21/679 |
| 4,345,756 | * | 8/1982 | Hoagland | 482/109 |
| 4,431,185 | * | 2/1984 | Cisneros | 482/139 |
| 4,641,836 | * | 2/1987 | Clifton | 482/109 |
| 4,730,828 | * | 3/1988 | Lane | 482/98 |
| 5,076,578 | * | 12/1991 | Askonen | 482/139 |
| 5,496,240 | * | 3/1996 | Damm | 482/93 |
| 5,540,640 | * | 7/1996 | Povilaitis | 482/108 |
| 5,709,634 | * | 1/1998 | Pointer | 482/105 |

FOREIGN PATENT DOCUMENTS

| | | | | |
|---|---|---|---|---|
| 2 176 123 | * | 12/1986 | (GB) | 482/106 |
| 1146068 | * | 3/1985 | (SU) | 482/106 |

* cited by examiner

*Primary Examiner*—John Mulcahy
*Assistant Examiner*—Victor K. Hwang
(74) *Attorney, Agent, or Firm*—Alfred F. Hoyte, Jr.

(57) ABSTRACT

A weightlifting apparatus for exercising the triceps includes a central weight bearing section with opposing handles, each handle having multiple gripping positions. The combined assembly has a center of gravity which lies between handle extensions, both laterally and longitudinally. The apparatus may be held behind the head and then repeatedly extended over the head in order to isolate and exercise the triceps. The centrally located weight bearing section can accommodate a number of weight plates and includes a clamping arrangement for securely holding the plates in a central position. A number of other exercises are facilitated with the apparatus.

8 Claims, 4 Drawing Sheets

WEIGHTLIFTING APPARATUS FOR EXERCISING THE TRICEPS

BACKGROUND OF THE INVENTION

The present invention relates generally to weightlifting equipment. More particularly, it relates to an improved exercise apparatus for isolating the triceps muscles.

STATEMENT OF THE PRIOR ART

Various types of barbell and dumbbell arrangements for isolating specific muscle groups are known. Additionally, other non-traditional exercising apparatus purporting to isolate and exercise a specific muscle group or groups are available. These apparatuses generally suffer from major drawbacks. One major drawback is that all barbell apparatuses having a relatively long bar are difficult to balance. There are two reasons for this difficulty. First, because the bar is long and the weight is very heavy relative to the bar, significant torque is generated since the weights are connected to the end of the bar thus producing a long lever arm depending upon the user hand positions. Also, even most accomplished body builders have strength differences between their left and right arms, requiring the user to exert extra strength to both compensate for the strength difference and balance the weight. Once the user becomes fatigued, the ability to compensate for the weight difference is seriously compromised resulting in a dangerous off balance position which has often resulted in injury.

Accordingly, some apparatuses which do not use weights have been devised. These apparatuses tend to be associated with large expensive fitness machines which have limited effectiveness for serious body builders and are thus rarely used by them. Furthermore, these apparatuses tend to use mechanical parts which are highly specialized and subject to failure such as rubberized bands and tension means, and hydraulics. Finally, weight bearing exercise apparatuses having a centered weight or weights have been devised. None of these apparatuses is seen to be as effective as the present invention.

Another common problem, specifically associated with triceps exercisers is that most equipment used for working triceps require that palms face upward. This type of hand position makes it difficult to keep the elbows inward especially while lifting heavy weight. Without strict form, other upper body muscles are recruited while lifting the weight. This action reduces the effectiveness of the exercise.

Another common problem with triceps exercisers is the inability to keep proper and strict form while performing overhead triceps extensions. The traditional way to perform this exercise is with either a straight bar or curl bar, in an overhead position, with palms facing up. This exercise requires that the bar be lowered behind the neck and then back up above the head. The problem with this movement is keeping strict form. Due to palm position (facing up) it's awkward keeping elbows in and palms facing up throughout this movement. There's a natural tendency to allow the elbows to protrude outward, away from the body.

U.S. Pat. No. 4,605,222 issued to Shannon discloses a weightlifting exercising bar. The bar has a center section with grasping handles formed therein. The weights are disposed on either end of the bar. While this apparatus can be used to isolate triceps, it suffers from the aforementioned balancing problem. The apparatus also allows for only one hand placement. By contrast, the present invention has a centrally located weight plate securing means which substantially reduces the balancing problem.

U.S. Pat. No. 5,709,634 issued to Pointer discloses a dumbbell adapted to be held behind the user's head while performing sit ups. While Pointer does disclose a central weight, he does not disclose hand position and spacing conducive to triceps extensions. By contrast, the present invention discloses a triceps extension apparatus which allows multiple hand positions and spacing.

None of the above inventions and patents, taken either singly or in combination, is seen to describe the instant invention as claimed.

SUMMARY OF THE INVENTION

The present invention overcomes the disadvantages of the prior art by providing a weightlifting apparatus for exercising the triceps. The apparatus includes a central weight bearing section with opposing handles, each handle having multiple gripping positions. The apparatus may be held behind the head and then repeatedly extended over the head in order to isolate and exercise the triceps. The weight bearing section can accommodate a number of weight plates and includes a clamping arrangement for securely holding the plates in a central position. A number of other exercises are facilitated with the apparatus.

The primary hand position on the apparatus of the present invention requires a closed (facing each other) hand position. By utilizing this unique hand position, the arms are forced to stay closer together, therefore retaining strict triceps isolation throughout the movement. When fatigue sets in during an exercise, there is a tendency to break form to complete the exercise. The apparatus will not allow deviation because the hand position forces the elbows to remain inward.

Alternatively, the apparatus allows for a standard or traditional hand position. This hand position is achieved by using both hands and grabbing hold of each inside arch of the unit.

The apparatus alleviates the tendency to resort to improper form, thereby recruiting other muscles to complete the exercise, by changing hand position, by changing from a palms up hand position to an end-to-end hand position. This creates a natural feel, making it easier to keep the elbows perpendicular to the body.

Accordingly, it is a principal object of the invention to provide an improved weightlifting apparatus for exercising the triceps.

Accordingly, it is an object of the invention to provide an improved weightlifting apparatus for exercising the triceps which has a centrally located weight bearing section.

It is another object of the invention to provide an improved weightlifting apparatus for exercising the triceps which has opposing handles with multiple gripping positions.

It is another object of the invention to provide an improved weightlifting apparatus for exercising the triceps which allow for end to end hand placement.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
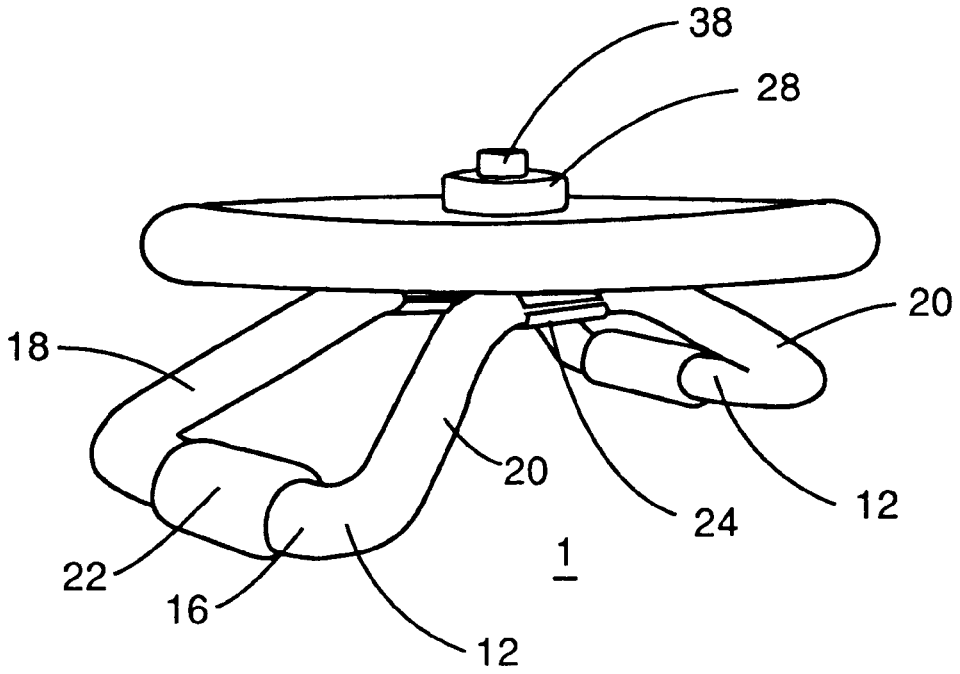
FIG. 1 shows a perspective view of the weightlifting apparatus of the present invention.
Figure 2:
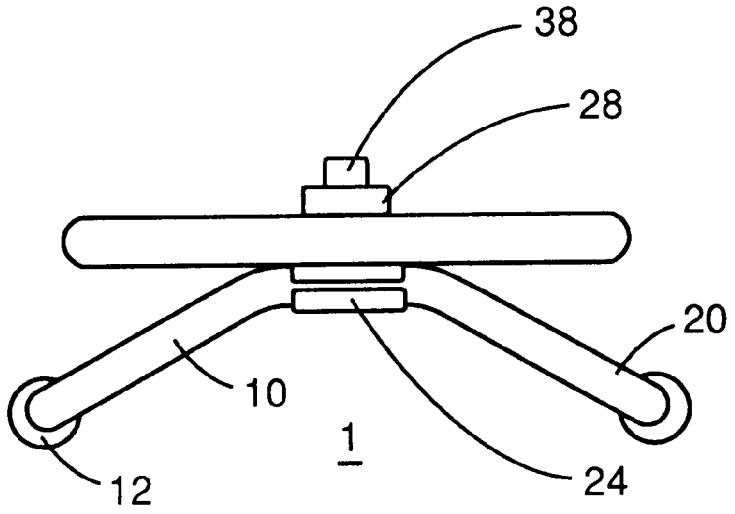
FIG. 2 shows a side view of the weightlifting apparatus of the present invention.
Figure 3:
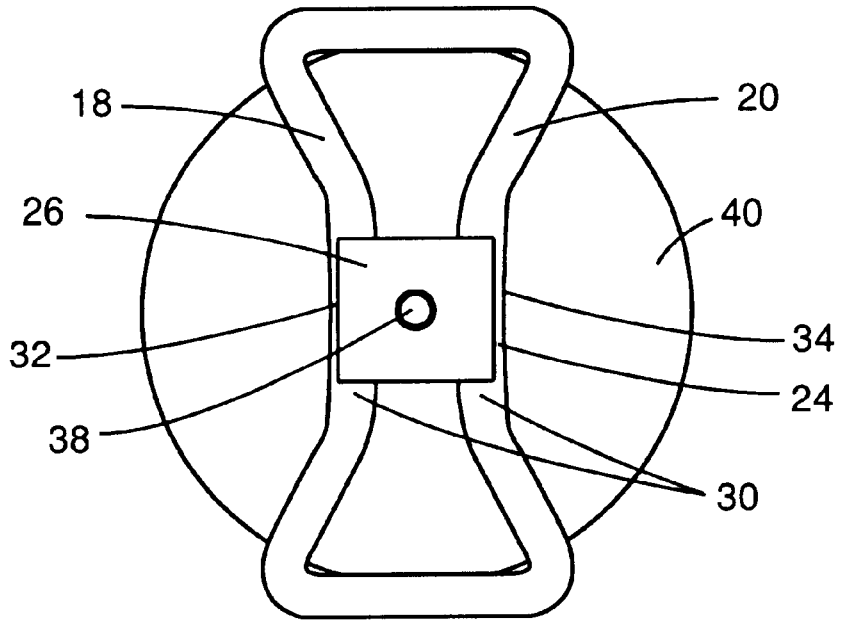
FIG. 3 shows a bottom view of the weightlifting apparatus of the present invention.
Figure 4:
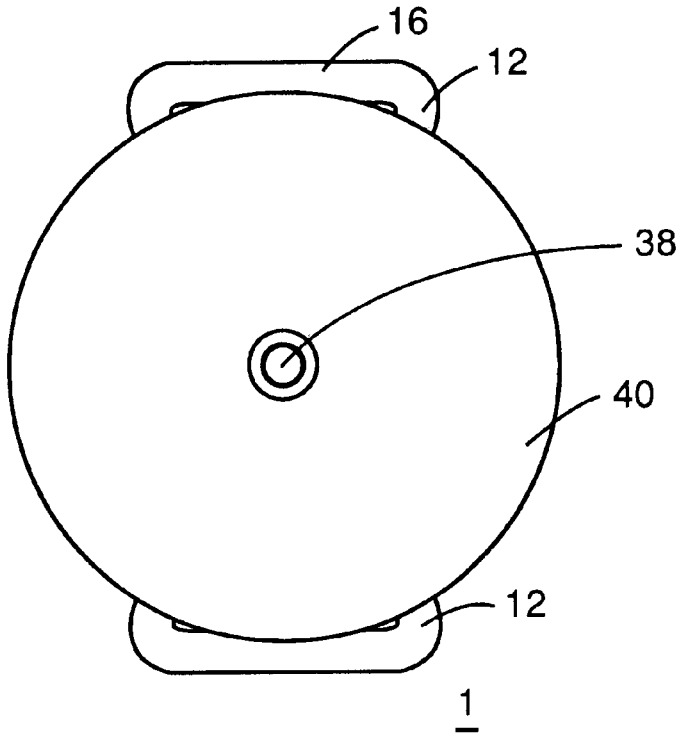
FIG. 4 shows a top view of the weightlifting apparatus of the present invention.

Referring now to FIGS. 1–8, the apparatus of the present invention, generally indicated by the numeral 1, is shown. The apparatus 1, has particular application as a triceps exerciser, its shape facilitating overhead triceps extensions. The apparatus has two main components, the bar and handle assembly, and the support and clamping assembly.

The bar 10 is preferably formed by bending a single, solid piece of iron bar or tube stock. The tube stock should be about 1 inch in diameter, and should have a total length of about 4 feet. This length of bar 10 will create an optimal hand spacing for the average weightlifter as will be explained in more detail later. Of course a longer bar 10 may be used. The surface of bar 10 can be bare metal, plated, plastic coated or painted, as desired. Also, the surface of the bar 10 may be textured to enhance grip. The bar 10 has two mutually opposed handle extensions, 12, each extension having a main handle portion 16, and two alternate gripping areas 18, 20. The main handle portion 16 may include a padded sleeve 22. The final configuration of bar 10 is characterized in that the combined assembly has a center of gravity which lies between handle extensions 12, both laterally and longitudinally. This feature is significant since it enables a user to grasp handles 12 and lift bar 10 without there being a resultant torsional loading exerted on the user's wrists. This feature would not result if the main handle portions 16 were offset. It can be seen that the bar 10 has a level portion 24 parallel to weight bearing platform 26 which, in the event the bar is 4 feet long, may be about 4 inches.

The handle extensions each extend from the level portion of the bar at an oblique angle of about 20 degrees so that the main handle portions occupy a plane offset from the level portion of the bar. The main handle portions are parallel to one another and the alternate gripping areas extend inwardly towards one another from the main handle portion to the level portion of the bar.

The weight bearing platform 26 and releasable clamping means 28 form the support and clamping assembly. The bar 10 is secured to the centrally located weight bearing platform 26 which may be made of the same material as the bar 10. Attachment of the platform 26 to the bar 10 is preferably accomplished by welding to eliminate a single stress point, or a plurality of stress points which can cause failure of the apparatus 1 after repeated use or during heavy weightlifting. While the platform 26 is shown as square, any shape will suffice for the platform, provided it is symmetrical. Also, bar 10 may be welded to the underside of the platform 26 allowing the platform 26 to be relatively large. It can be appreciated that the width and length of the platform 26 is limited to the space 30 between parallel bar segments 32, 34 and the length of the flat portion 24 of the bar, respectively. An upstanding post 38 is used to position a weight or weight plates 40 on the platform 26. Of course, the upstanding post 38 is centrally located to ensure that the symmetry of the apparatus I is maintained. Clamping member 28 which may be a conventional locking collar as is well known in the art, is securely fastened about the post 38 anchor the weights onto the platform 26.

Figure 5:
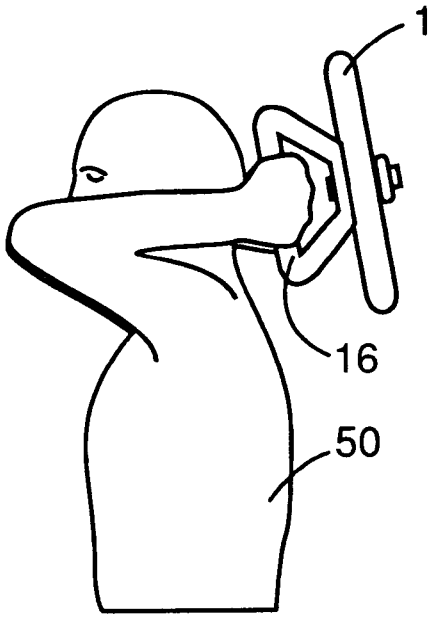
FIG. 5 shows a side view of a user using the weightlifting apparatus in an initial position.
Figure 6:
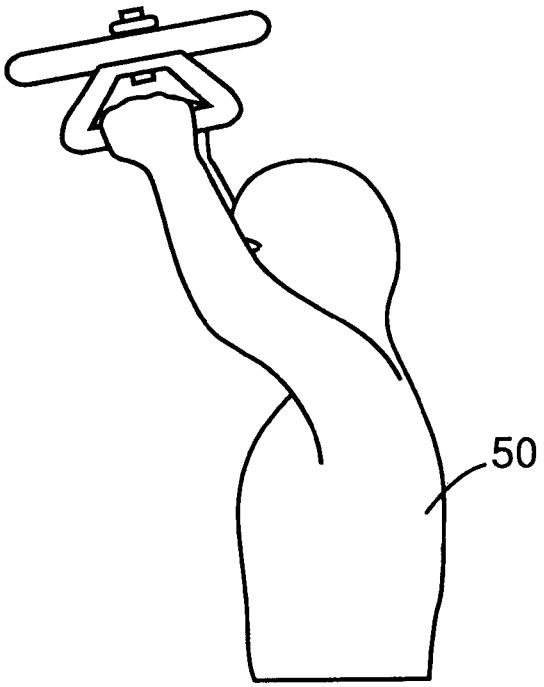
FIG. 6 shows a side view of a user using the weightlifting apparatus in a fully extended position.
Figure 7:
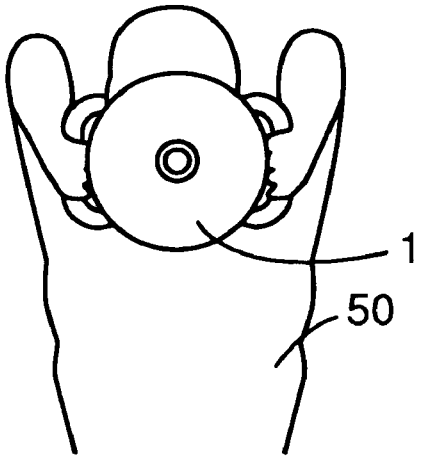
FIG. 7 shows a rear view of a user using the weightlifting apparatus in an initial position.
Figure 8:
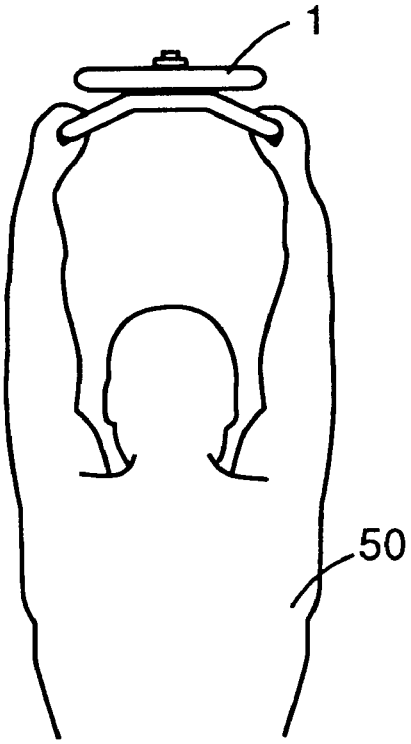
FIG. 8 shows a side view of a user using the weightlifting apparatus in a fully extended position.

The use of the apparatus 1 will now be explained for various types of exercise movements. FIGS. 4–8 illustrate the apparatus 1 being used for a triceps extension exercise. The initial position of the user 50 when performing the triceps exercise movement is shown with reference to FIGS. 5 and 7. FIG. 5 illustrates a side view of the initial position of the bar with respect to the user. Both hands grasp main handles 16 and the bar is placed behind the user's head. The bar is thereafter raised along an arc over the user's head to the position shown in FIGS. 6 and 8. The positioning and orientation of handles 16 is ideal for the triceps extension exercise since the user's hands are positioned end to end. By utilizing this unique hand position, the arms are forced to stay closer together, therefore retaining strict triceps isolation throughout the movement. As the apparatus 1 is lifted over the user's head, there is no resultant torque load being imposed on the user's wrist due to the center of gravity placement described previously. Use of a conventional barbell for this exercise results in an undesirable grasping angle, and the elbows are forced outward, as opposed to the grasping angle illustrated in FIG. 7 where the elbows are in. A more traditional hand placement may be facilitated by grasping the apparatus 1 by grasping either of the alternate gripping areas 18, 20. It can be seen that the width of the apparatus 1 also serves a role in causing optimal hand placement as has been previously described. The apparatus may be made slightly larger to accommodate weightlifters with exceptionally wide shoulders.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A weightlifting exercise apparatus comprising:

a substantially planar central portion having opposite ends and occupying a first plane;

said central portion having a post mounted thereto such that said post extends substantially perpendicularly from said first plane so that said post may receive at least one weight plate;

a pair of handle portions extending from said opposite ends of said central portion;

each said handle portion having a pair of secondary grip portions and a main grip portion extending between said secondary grip portions so that said main grip portions are parallel to one another;

each said secondary grip portion extending from said central portion at an oblique angle so that said main grip portions are located in a plane offset from and parallel to said first plane; and said main grip portions and said secondary grip portions formed of bar stock material.

2. A weightlifting exercise apparatus as claimed in claim 1, wherein said oblique angle at which said secondary grip portions extend from said central portion is about 20 degrees.

3. A weightlifting exercise apparatus as claimed in claim 1, wherein said handle portions are formed of a single piece of bar stock material.

4. A weightlifting exercise apparatus as claimed in claim 3, wherein said bar stock material is metal bar stock material.

5. A weightlifting exercise apparatus as claimed in claim 1, wherein said post is mounted to said central portion by a platform secured to said central portion.

6. A weightlifting exercise apparatus as claimed in claim 1, wherein said handle portions include texture to enhance gripping of said handle portions by a user.

7. A weightlifting exercise apparatus as claimed in claim 1, wherein said handle portions include padding to enhance gripping of said handle portions by a user.

8. A weightlifting exercise apparatus as claimed in claim 1, wherein said secondary grip portions extend inwardly towards one another from opposing ends of said main grip portion to said central portion.

* * * * *